United States Patent [19]

Samuelson

[11] 4,157,241

[45] Jun. 5, 1979

[54] FURNACE HEATING ASSEMBLY AND METHOD OF MAKING THE SAME

[75] Inventor: Wayne H. Samuelson, Bedford Heights, Ohio

[73] Assignee: Avion Manufacturing Co., Cleveland, Ohio

[21] Appl. No.: 744,509

[22] Filed: Nov. 24, 1976

Related U.S. Application Data

[63] Continuation-in-part of Ser. No. 671,285, Mar. 29, 1976, abandoned.

[51] Int. Cl.[2] ..... F23D 15/02

[52] U.S. Cl. ..... 431/353; 126/91 A; 239/298; 431/349

[58] Field of Search ..... 239/296, 468, 472, 298, 239/548; 431/353, 349, 350; 126/91 A

[56] References Cited

U.S. PATENT DOCUMENTS

| | | | |
|---|---|---|---|
| 2,784,778 | 3/1957 | Milton | 431/353 X |
| 2,789,633 | 4/1957 | Flynn | 431/353 X |
| 3,002,553 | 10/1961 | Reed | 431/353 X |
| 3,574,506 | 4/1971 | Locke | 431/353 X |

*Primary Examiner*—Edward G. Favors
*Attorney, Agent, or Firm*—Watts, Hoffmann, Fisher & Heinke Co.

[57] ABSTRACT

A heating assembly for a heat treating furnace is disclosed which includes a heating tube from which heat is transferred to the furnace and a burner disposed in the heating tube. The burner is connected to a source of mixed fuel and air and is constructed to define a mixture inlet section, a throat section and a discharge section. A primary mixture flow passage is defined by the throat section and secondary mixture flow passages communicate with the discharge section to impinge secondary mixture flows into the primary flow and impart a vorticular motion to the mixture flowing from the burner.

The burner is constructed from a first relatively easily machined member which defines the inlet and throat sections and in which the secondary passages are formed. A second tubular cylindrical heat resistive member defines the discharge section and the members are shrink fitted together to enable reconditioning of the burner by replacement of the second member.

21 Claims, 7 Drawing Figures

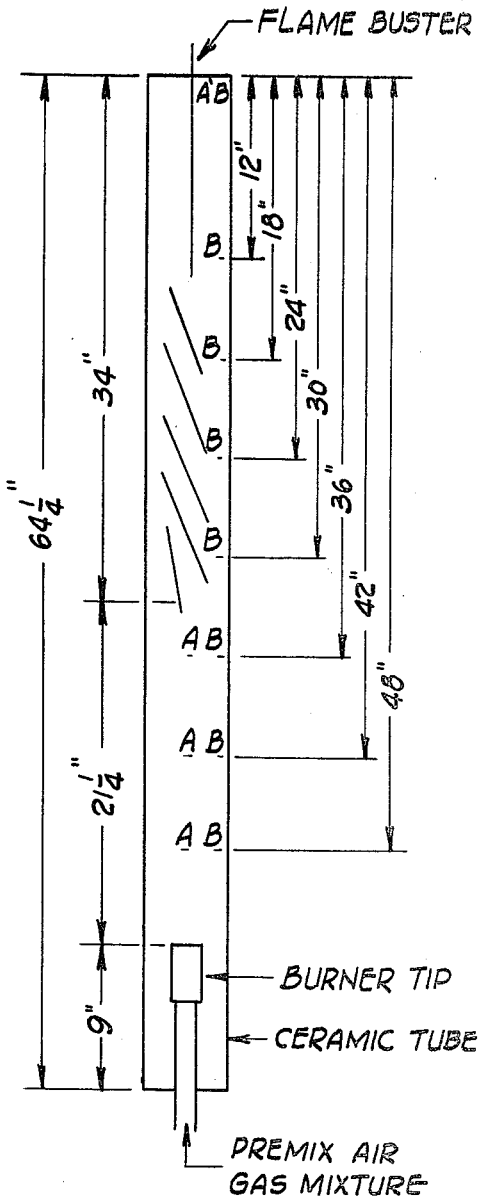

Fig. 6

| LOCATION / CONDITION | NEW | AVERAGE DIFFERENCE | OLD |
|---|---|---|---|
| A-48 HIGH FIRE | 2420°F | 0°F | 2420°F |
| B-48 HIGH FIRE | 2440°F | +20°F | 2420°F |
| A-42 HIGH FIRE | 2410°F | -15°F | 2425°F |
| B-42 HIGH FIRE | 2440°F | +20°F | 2420°F |
| A-36 HIGH FIRE | 2385°F | -55°F | 2440°F |
| B-36 HIGH FIRE | 2430°F | +40°F | 2390°F |
| B-30 HIGH FIRE | 2390°F | +100°F | 2240°F |
| B-24 HIGH FIRE | 2320°F | +140°F | 2180°F |
| B-18 HIGH FIRE | 2240°F | +140°F | 2100°F |
| B-12 HIGH FIRE | 2090°F | +70°F | 2020°F |
| TOP A' HIGH FIRE | 1860°F | -60°F | 1920°F |
| TOP B' HIGH FIRE | 1940°F | +20°F | 1920°F |
| A-48 LOW FIRE | 2190°F | 0°F | 2190°F |
| B-48 LOW FIRE | 2190°F | 0°F | 2190°F |
| A-42 LOW FIRE | 2140°F | -30°F | 2170°F |
| B-42 LOW FIRE | 2180°F | +40°F | 2140°F |
| A-36 LOW FIRE | 2060°F | -80°F | 2140°F |
| B-36 LOW FIRE | 2140°F | +60°F | 2080°F |
| B-30 LOW FIRE | 2110°F | +90°F | 2020°F |
| B-24 LOW FIRE | 2080°F | +160°F | 1920°F |
| B-18 LOW FIRE | 1890°F | +70°F | 1820°F |
| B-12 LOW FIRE | 1740°F | +30°F | 1710°F |
| TOP A' LOW FIRE | 1650°F | 0°F | 1650°F |
| TOP B' LOW FIRE | 1660°F | +10°F | 1650°F |

Fig. 7

FURNACE HEATING ASSEMBLY AND METHOD OF MAKING THE SAME

CROSS REFERENCE TO RELATED APPLICATION

This application is a continuation-in-part of U.S. patent application Ser. No. 671,285 filed Mar. 29, 1976, now abandoned.

BACKGROUND

Field of the Invention

The present invention relates to heating assemblies and more particularly to fuel burners for furnace heating assemblies and a method of making the same.

Heating assemblies for metallurgical or heat treating furnaces raise the furnace atmosphere to a set point temperature range rapidly and then maintain the furnace atmosphere in the set point temperature range for a desirable period of time. The heated furnace atmosphere is circulated between a number of the heating assemblies and a furnace work zone containing material to be heat treated. The heating assemblies are commonly formed by a heating tube and a fuel burner disposed within the tube for maintaining a tube wall heating flame. The tube wall, in turn, transfers heat to the furnace by radiation and by convective heat transfer. The heating tubes exhaust outside of the furnace and thus serve to isolate the furnace atmosphere from the gasses in the tubes.

The prior art burners have generally been supplied from a source of fuel (e.g. natural gas) and combustion air and have introduced mixed fuel and air into their heating tubes. The fuel and air should be mixed in proportions to assure optimum combustion, i.e., a so-called stoichiometric fuel-air mixture ratio should be provided. Combustion has been initiated by a pilot flame associated with each heating tube remote from the burner and, once established, combustion occurs in a flame which extends from within a discharge section of the burner through the heating tube to a location where the fuel is consumed.

The mass flow rate of the fuel and air supplied to the burner is variable and governed thermostatically according to sensed furnace atmosphere temperature to maintain the furnace atmosphere in a desired set point temperature range. The furnace is initially heated into the set point range by combustion of the mixture flowing through the burners at a maximum flow rate. This is referred to as the "high fire" condition in that a large flame is maintained in the heating tube. When the set point temperature is reached, the mixture flow is throttled back to a predetermined level where the furnace atmosphere temperature remains constant, or decreases gradually. This condition is referred to as the "low fire" condition. If the temperature drops below the set point range the maximum fuel-air flow rate is reestablished to rapidly increase the furnace atmosphere temperature.

The burners tend to become extremely hot during furnace operation because of their direct exposure to the flame. The heat, coupled with the oxygen rich atmosphere ambient the burner, is quite destructive and the burners are eventually consumed, albeit gradually, beginning with the material forming the burner discharge opening. Burners have conventionally been constructed from so called high temperature alloys which resist consumption to maximize the effective burner life and reduce the costs attendant to burner replacement.

High temperature alloys which are most frequently used for burners have exhibited extremely poor machinability resulting in the burners being rough in that they are characterized by having generally poor surface characteristics, burrs, etc. The rough nature of the burners tends to create erratic fluid flows which accelerate their consumption rates and the consumption occurs unevenly. These factors result in unstable, poorly formed flames in the heating tubes, particularly under "low fire" conditions.

Unstable and/or poorly formed flames are undesirable because they reduce the overall furnace efficiency. These flames often produce zones of maximum combustion heat in the central portions of the heating tubes remote from the walls. This results in furnace inefficiency due to failure to maximize the transfer of heat to the tube walls from the flame.

Unstable flames also tend to promote explosive back flashing of unburned fuel in the heating tubes when the burner condition is altered from "high fire" to "low fire", as well as in those circumstances where the burner flame is lit and relit during the furnace operation. When the fuel flow rate is reduced to the low fire level the mixture flow configuration is believed to change significantly in circumstances where unstable flames are present. This can result in movement of the flame base away from the burner tip while unburned fuel and air continues to be introduced into the tube behind the flame base. The unburned mixture accumulates until lit by the heating tube pilot flame remote from the burner. The resultant back flash tends to be sufficiently explosive that the heating tube wall can be broken particularly when the fuel-air mixture is not properly adjusted, which is not an infrequent occurrence.

Still further, unstable flames often create heating tube wall hot spots. The existance of a tube wall hot spot creates localized wall temperature differentials and consequent localized tube wall stresses. These stresses can be sufficiently great to crack the tubes.

Furnace heating tubes are fragile and when broken are expensive and difficult to replace. The heating tubes have generally had thin ceramic walls suitable for radiating heat efficiently and capable of withstanding the effects of extremely high temperatures, chemically active environments and rapid temperature changes without loss of structural integrity. These materials are brittle, have relatively low tensile strengths and if a tube breaks or cracks the furnace atmosphere can be contaminated by products of combustion. Accordingly, broken tubes must ordinarily be replaced promptly to avoid possible damage to furnace contents.

Breakage and replacement of furnace heating tubes has been a significant problem. The heating tubes are relatively expensive in themselves and the costs attributable to labor and furnace downtime required for tube replacement are high. Heating tubes have been broken rather frequently by stresses resulting from unequal heating of the tube walls and explosive back-flashing of unburned fuel in the tube. For the reasons noted these causes are attributable to the construction of the fuel burners.

One widely used prior art burner is formed by a one piece cylindrical tube of heat resistant metal having an inlet section, a reduced diameter throat section and a discharge section. The inlet section is threaded so that the burner can be screwed onto a fuel supply pipe. Both the inlet and discharge sections are of relatively great length compared to the throat section.

A conical converging wall leads into the throat from the inlet section and series of passages extends through the burner wall parallel to the throat from the inlet section to the discharge section. These passages are spaced circumferentially apart and diverge proceeding toward the discharge section. Each passage is formed by a straight drilled hole having its central axis disposed in a plane coextending with the burner axis. The divergent passages direct the fuel and air mixture onto the discharge section wall. The mixture flowing through the passages tends to be reflected from the discharge section wall back into the main stream of the mixture flowing through the discharge section from the throat section. This construction has produced a turbulent mixture flow and flame, but flame contact with the heating tube walls has not been maximized.

The prior art burner construction referred to has been formed by machining a single piece of relatively heat resistant metal bar stock. Because these alloys generally exhibit extremely poor machinability the burners have been expensive to manufacture, have had relatively short effective lives due to consumption at high temperatures, have contributed significantly to burner tube breakage because of their tendencies to produce unstable and/or poorly formed flames, and have contributed to furnace inefficiency by transferring less than optimum quantities of heat to the heating tubes.

These burners have tended to be consumed by a combination of oxidation and incipient melting which has begun at the tips of the burners and along axially extending regions traversed by the flows from the diverging passages. Consequently the burner discharge passages tend to become shorter and divergent as the burners are consumed. As consumption progresses the burner flames become progressively more unstable which encourages heating tube cracking. When a burner tip is consumed to the point where the diverging passages direct their flows onto the heating tube walls, the resultant tube wall hot spots cause heating tube breakage rather promptly if the burner is not replaced.

The have been proposals to rebuild partially consumed burners of the type referred to by removing the original, partly consumed tips, and replacing them with sleeves which are welded to the remainder of the burner. These proposals were not successful because the weld joints failed rapidly as a result of thermal fatigue and corrosion.

SUMMARY OF THE INVENTION

The present invention provides a new and improved furnace heating assembly including a furnace heating tube and a burner, the latter being constructed and arranged so that heat transfer to the furnace from the heating tube is relatively efficient and the burner flame is highly stable in both the high and low fire burner conditions, thus contributing to maximum heating tube life.

Another important feature of the invention resides in the construction of a furnace heating burner in such a way that the burner has a materially increased life compared to prior art burners, produces stable burner flames, is relatively easily manufactured, and wherein the effects of high temperature corrosion, or consumption, can be repaired without requiring the complete replacement of the burner.

In accordance with a preferred embodiment of the invention a furnace heating assembly is provided which includes a burner tube and a burner disposed within the tube. The burner is connected to a source of a fuel and air mixture and directs the mixture in a generally helical flow path around and along a line extending within the burner tube. The burner defines an inlet section, a throat section and discharge section. A primary mixture flow passage is formed in part by the throat section and a plurality of secondary flow passages, spaced radially from and about the line, bypass secondary flows of fuel-air mixture around the primary flow passage. The secondary flows are directed into the discharge section along flow paths which are skewed with respect to the line and which interact with the primary flow in the discharge section to impart a helical, or vorticular, swirling motion to the mixture issuing from the burner.

The swirling motion has been found to insure that the burner flame is stable. If there are rough surfaces in the burner discharge section, the effects which might otherwise result in erratic flow configurations from the burner are obviated by the overall swirling motion. Moreover the swirling motion shapes the flame into a desirable configuration. The relatively heavy unburned components of the mixture tend to be slung against the heating tube wall where they are burned so that the flame, by and large, is maintained in the vicinity of the wall even at locations remote from the burner. The less dense products of combustion tend to be displaced toward the center of the vorticular flow away from the tube wall. Heat transfer to the tube wall is maximized in this way and the furnace efficiency is improved.

Temperature measurements made under actual operating conditions have indicated that the temperature at the wall of the tubes tends to be markedly higher than the gas along the central axis of the heating tube.

Still further, the swirling motion imparted by the new burner assures that when the mixture flow rate is altered from the high fire to the low fire condition the flow of mixture into the heating tube maintains the same general flow configuration. This minimizes the possibility of explosive flash backs.

Another important feature of the invention resides in the construction of a furnace burner which is particularly adapted for long lived extremely high temperature operation, relatively easily machined, formable with extremely smooth surfaces in the high temperature sections of the burner and which can be partially replaced when necessitated by high temperature corrosion or erosion.

In the preferred burner construction a mixture inlet section is connectable to a fuel and air supply line and leads into the throat section. The inlet and throat sections, together with the secondary mixture flow passages, are formed in a first burner member. A second burner member, formed by a tubular second body member, projects beyond the first body member to define the discharge section into which the primary and secondary mixture flow passages direct the fuel and air mixture. The burner members are connected together by intimately engaged surfaces which define an interference fit with each other when the members are at substantially the same temperature.

The new burner construction assures first, that the burner can be made relatively easily since the first body member is machined completely before assembly to the second body member. The first body member construction assures that machine tools have free access to the areas of the first body member which need to be machined, such as the throat section and secondary flow passages. The second body member is formed from a highly corrosion-resistant alloy which need not be subjected to intricate machining steps and has its entire inner surface ground to assure surface smoothness of the burner discharge section. The alloys available for most effective use in the second body member are extremely difficult to machine and therefore the simplicity of the second member facilitates production. The first member, because it is not subjected to such extreme heat, can be formed from alloys which are relatively easily machined, compared to the material forming the second body member.

It should be appreciated that even though combustion occurs within the discharge section of the burner, and the discharge section of the burner becomes extremely hot immediately adjacent the burner flame, the mixed fuel and air flowing through the throat section and the secondary flow passages maintains the first body member and the juncture of the first and second body members at a low enough temperature that they are not corroded or eroded appreciably during operation of the burner.

Even a burner constructed according to the present invention will be consumed gradually and when this occurs the burner need not be replaced entirely. The first and second body members are attached by a so-called heat shrink or shrink-fit connection. Preferably the second burner member is heated substantially above the temperature of the first member and the members are assembled. The second member cools down and contracts into engagment with the first member. When the junctures of the body members are at nearly the same temperature the members are securely fixed together.

When the burner discharge section has been substantially consumed and replacement becomes necessary, a substantial temperature differential is established between the first and second burner members and the members are pulled apart. A replacement second burner member is then assembled to the first burner member by a shrink-fit connection in the manner described previously.

Other objects and advantages of the invention will become apparent from a detailed description of a preferred embodiment made with reference to the accompanying drawings which form a part of the specification.

BRIEF DESCRIPTION OF THE DRAWINGS

FIG. 6 is a view similar to FIG. 2 schematically illustrating a furnace heating assembly and showing points in the heating system at which data is taken; and FIG. 7 is a table of the data taken at locations indicated in FIG. 6.

DESCRIPTION OF A PREFERRED EMBODIMENT

Figure 1:
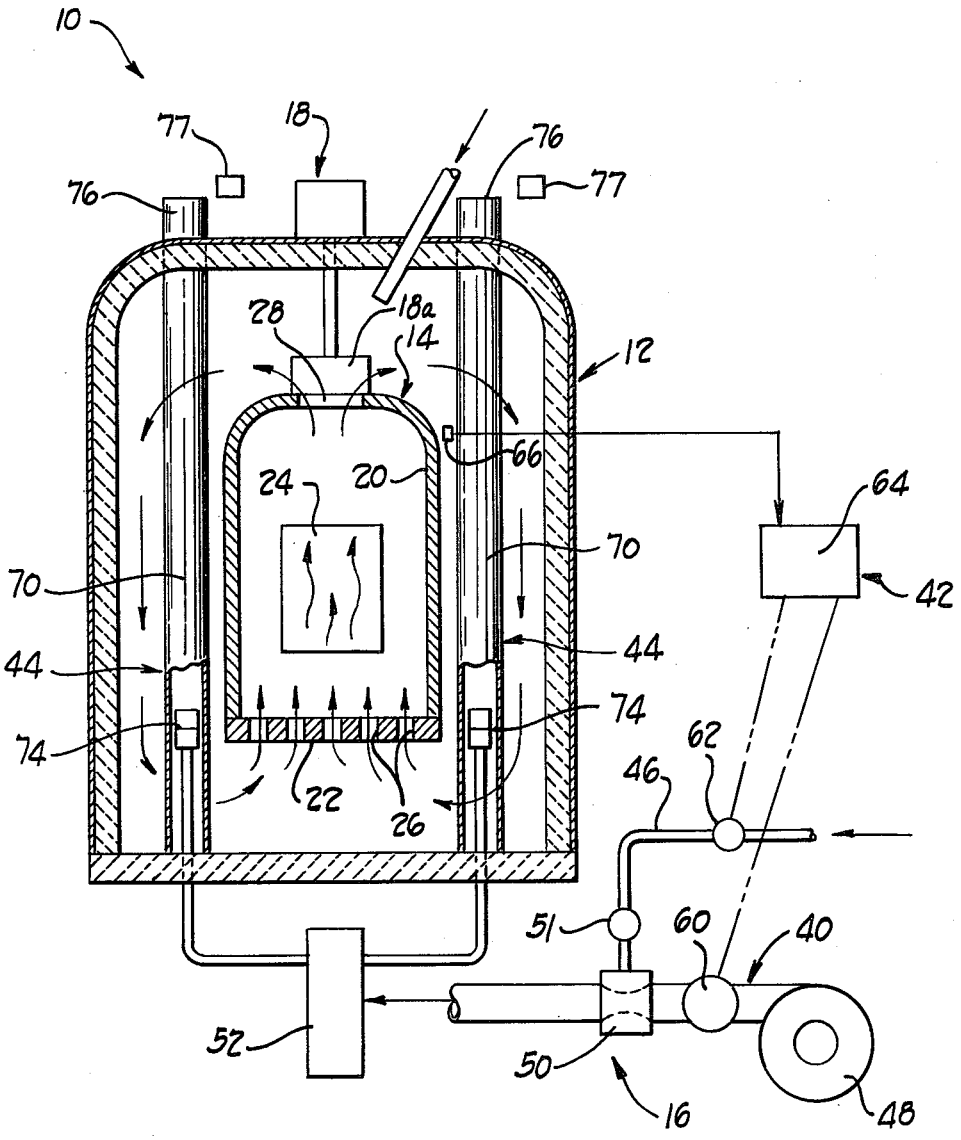
FIG. 1 is a cross sectional schematic view of a heat treating furnace embodying the present invention.

A heat treating furnace 10 embodying the present invention is illustrated schematically by FIG. 1 of the drawings. The heat treating furnace 10 includes a heat insulative wall 12 surrounding a working zone 14 in which contents of the furnace to be heat treated are supported, a furnace atmosphere heating system generally by the reference character 16, and a circulating fan system 18 for circulating the furnace atmosphere between the working zone and the furnace heating system.

The heat insulative furnace wall 12 can be of any suitable construction and is therefore neither illustrated nor described in detail. Suffice it to say that the wall is formed by a base, side walls and a top. The illustrated wall has an outer housing of sheet-like material which is lined with a refractory material, such as refractory bricks. The outer housing is suitably sealed so that leakage of the furnace atmosphere from the furnace into the surrounding atmosphere, or vice versa, is minimized.

The working zone 14 is formed by an internal furnace housing 20 which extends above a hearth 22. A basket 24 is disposed within the working zone for supporting parts to be heat-treated. The basket 24 is supported on a suitable conveyor which has not been illustrated. The heated furnace atmosphere is circulated through the working zone via intake openings 26 formed in the hearth and an exhaust opening 28 which is formed at the upper side of the housing 20.

The circulating fan system 18 includes a paddle-wheel type blower member **18*a* which is supported adjacent the housing opening 28 so that atmosphere in the working zone 14 is drawn through the exhaust opening 28, circulated around the outside of the housing 20 where it is heated from the system 16 and drawn back into the working zone through the hearth intake openings 26. A furnace atmosphere line 30 supported by the furnace wall 12** extends into the furnace adjacent to the blower member to introduce appropriate atmosphere gas. The furnace atmosphere is maintained at a pressure slightly greater than ambient atmospheric air pressure to assure that any leakage of the furnace walls results in furnace atmosphere flowing out of the furnace. This assures that the furnace contents are not damaged by exposure to atmospheric air at high temperatures.

The heating system 16 comprises a fuel supply system, generally indicated by the reference character 40, a control system 42 and furnace atmosphere heating assemblies 44 supported by the furnace wall 12 along opposite sides of the housing 20. The illustrated heat treating furnace is gas fired and the heating assemblies 44 are supplied with a mixture of fuel and air for combustion in the heating assemblies. The supply of fuel from the system 40 is governed by the control system 42 in response to sensed thermostatic conditions in the furnace.

The fuel supply system 40 is formed by a gas supply line 46, an air blower 48 and a mixing aspirator 50 connected to the discharge of the blower 48 and to the line 46 for mixing the air and gas in predetermined proportions. A pressure regulator 51 is associated with the aspirator 50 and cooperates with the aspirator so that a so-called stoichiometric mixture of air and gas in the aspirator is assured regardless of changes in the air flow rate into the aspirator. The mixture is delivered to a manifold 52 for distribution to the individual heating assemblies. The component parts of the supply system 40 may be of any conventional or suitable construction and therefore are neither shown nor described in detail.

The control system 42 includes an air flow control valve 60 and an "on-off" gas flow control valve 62 which are operatively connected to a valve operating unit 64. The unit 64 operates the control valves in response to furnace atmosphere temperatures sensed by a "set point" sensor 66. The sensor 66 is preferably a thermocouple which is electrically connected to the valve operating unit 64. The furnace operator manually operates a mechanism associated with the unit 64 to select the "set point" temperature range in which the thermocouple conditions the unit 64 to govern operation of the valves 60,62.

The air flow control valve 60 is preferably a "butterfly" type valve which is operable between a wide open position, in which the flow of air from the blower to the aspirator is substantially unimpeded, and an adjustable, controlled flow position at which the flow rate through the aspirator 50 is reduced to a desired level. The furnace operator manually adjusts the controlled flow position of the valve to govern the rate at which heat is transferred into the furnace when the valve is in the controlled flow position.

When a heat treating procedure is begun the temperature of the furnace and its contents are raised to the selected "set point" temperature level rapidly. To accomplish this the valves 60 and 62 are fully opened by the operating unit 64 and a maximum flow of fuel-air mixture is delivered to the heating assemblies 44. The fuel-air mixture in each of the heating assemblies 44 is ignited by a suitable pilot flame and the circulating furnace atmosphere is quickly heated. This condition of operation of the furnace is known as the "high fire" condition in that the flame produced by combustion of the mixture in each of the heating assemblies is a maximum size and intensity.

When the atmosphere passing the set point temperature sensor 66 reaches a desired level in the set point range the control unit 64 actuates the air flow control valve 60 to its reduced flow condition so that a preadjusted lesser flow rate of the air-fuel mixture is delivered to the heating assemblies. The flow controlling valve 60 is preadjusted to a lesser or controlled flow position which produces a constant or gradually decreasing furnace atmosphere temperature. This is the "low fire" condition of the heating assemblies. Operation of the air controlling valve 60 is generally such that the flow rate of the mixture to the heating assemblies is rather abruptly reduced to the "low fire" flow rate at which a smaller less intense combustion flame is maintained.

The furnace continues to operate in the "low fire" condition until the end of a predetermined heat treating cycle or until the sensor 66 detects a furnace atmosphere temperature below the lower limit of the set point temperature range. When the latter occurs the operating unit 64 actuates the air controlling valve 60 to its fully opened condition again so that the "high fire" condition is reestablished. The furnace atmosphere temperature is quickly raised into the set point temperature range and the low fire condition is reestablished.

In the event that the furnace atmosphere temperature should rise above the upper limit of the set point temperature range the sensor 66 conditions the operating unit 64 for closing the gas flow control valve 62 while the air flow valve 60 remains in its controlled flow position. The supply of gas to the aspirator 50 is cut off and air at atmospheric temperature is directed through the manifold 52 to the heating assemblies 44 to cool the furnace atmosphere. When the furnace atmosphere temperature is returned to the set point range the gas flow controlling valve 62 is reopened and the low fire condition is reestablished.

Each of the heating assemblies 44 includes a furnace atmosphere heating tube 70 which is attached to the furnace wall structure 12 by a mounting assembly 72 (see FIG. 2) and a burner 74 which is fixed within the heating tube 70 by the mounting assembly 72. The fuel-air mixture issues from the burner 74 into the heating tube along a swirling helical, or vorticular, flow path. Combustion of the mixture begins within the burner itself and continues throughout a substantial length of the heating tube 70 until the fuel is consumed. The vorticular motion assures that combustion occurs primarily along the heating tube walls to maximize the heat transfer to the heating tube walls as well as assuring a stable flame configuration in the heating tube.

The tube 70 is preferably formed by a straight cylindrical thin walled ceramic member having a base portion 75 supported at the lowermost part of the furnace wall 12 and a projecting end 76 (FIG. 1) which extends through the top of the furnace. The tube is resiliently clamped in place in the furnace and appropriately sealed to prevent atmosphere leaks from the furnace. The furnace atmosphere is flowed across the outsides of the tube to pick up the heat by convection and transfer the heat into the working zone. A suitable or conventional pilot burner 77, which is illustrated schematically, is supported near the projecting end of the tube 70 to maintain a pilot flame at the tube end.

Figure 2:
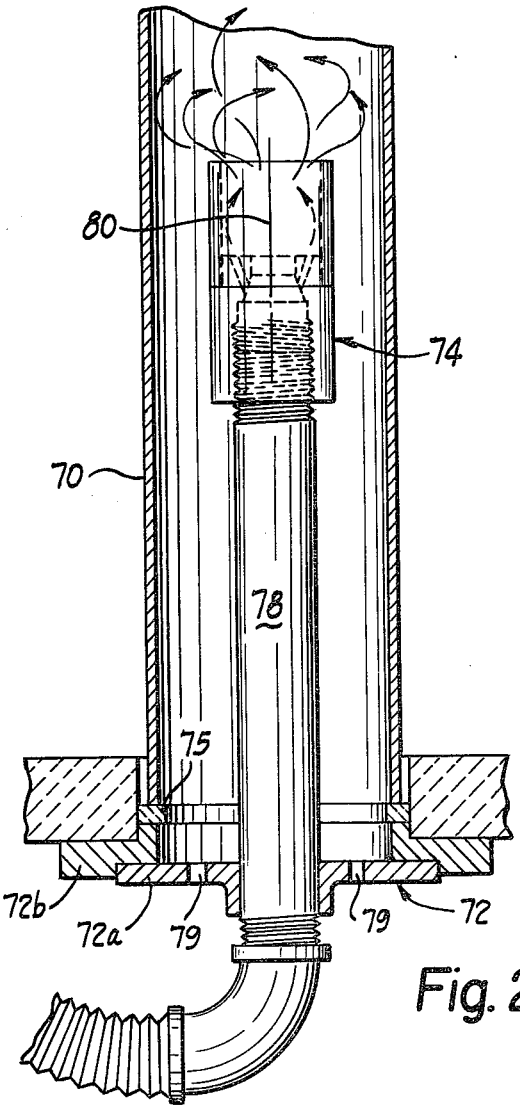
FIG. 2 is a fragmentary cross sectional view of a heating assembly forming part of the furnace of FIG. 1.

The mounting bracket 72 interconnects the tube base portion 75 will furnace base and, as illustrated by FIG. 2, is formed by nested mounting plates generally indicated by the reference characters *72a*, *72b* which support the tube within an opening in the furnace base and position a fuel pipe 78 centrally within the tube base portion 75. Small draft openings 79 are formed in the plate 76 at locations spaced about the fuel pipe 78 to admit a small flow of atmospheric air to the tube 20 upwardly along the pipe 78. The atmospheric air flow cools the pipe and, to some extent, the burner 74.

The burner 74 is formed by a generally tubular body disposed about a central axis 80 which generally coextends with the centerlines of the heating tube and the fuel pipe 78. The burner 74 is constructed and arranged to impart the helical swirling motion to the fuel-air mixture about the axis 80.

Figure 5:
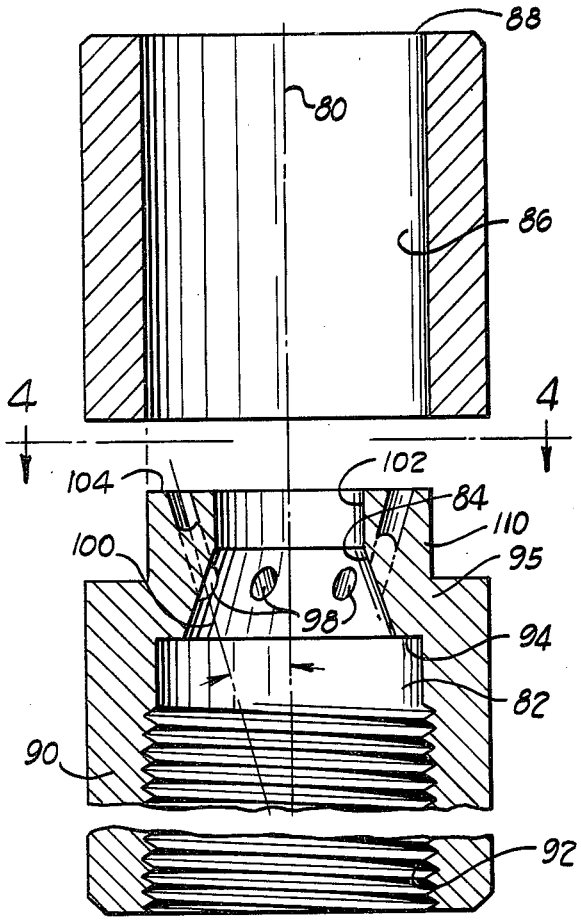
FIG. 5 is a cross sectional view of the burner illustrated by FIG. 3 with the component parts thereof separated.
Figure 4:
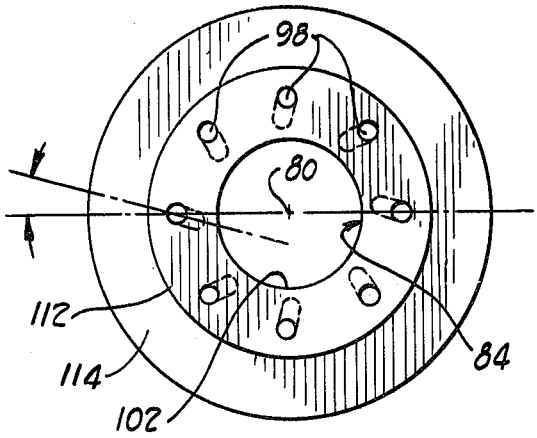
FIG. 4 is an elevational view seen from the plane indicated by the line 4—4 of FIG. 5.
Figure 3:
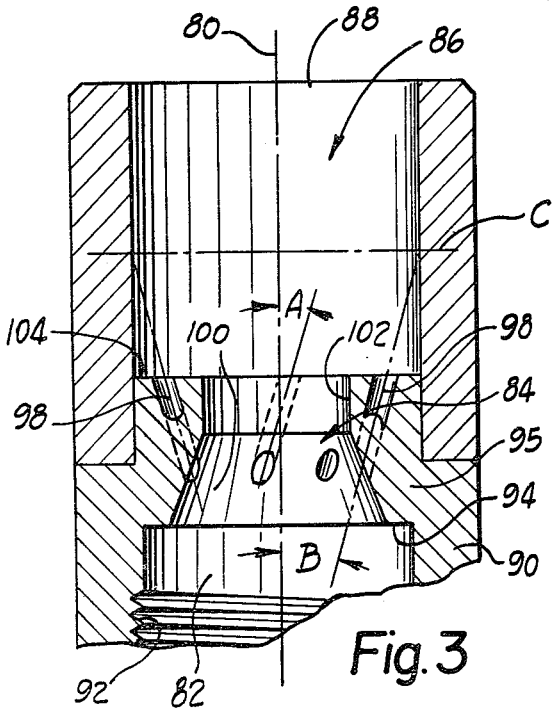
FIG. 3 is a fragmentary cross sectional view of a burner forming part of the heating assembly.

Referring to FIGS. 3 and 5, the burner 74 defines a fuel-air mixture inlet section 82 through which fuel and air mixture is introduced to the burner, a throat section 84 immediately downstream from the inlet section, a discharge section 86 into which fuel from the throat section is discharged at high velocity and combustion is initiated, and a discharge opening 88 at the end of the discharge section from which the swirling mixture issues into the tube 20. In the preferred burner the sections 82, 84, 86 and the discharge opening 88 are all of generally circular cross sectional shape with their centers lying on the axis 80.

The inlet section 82 is defined within a generally cylindrical burner wall portion 90 and provided with internal threads 92 by which the burner is screwed onto the fuel pipe 78. The inlet section terminates in a circumferential radially inwardly extending shoulder 94 at its downstream end.

The throat section 84 is formed by a burner wall portion 95 which defines a primary fuel flow passage and a plurality of smaller, secondary fuel flow passages 98 for directing a portion of the fuel-air mixture around the primary fuel flow passage. The wall portion 95 forms a converging conical channel 100 which extends from the shoulder 94 to a circular straight cylindrical orifice 102. The orifice 102 forms the principal part of the primary flow passage and directs the primary fuel-air mixture flow at high velocity into the discharge section 86. The preferred channel 100 has a cone angle of approximately 38°. The mixture flowing through the channel has its velocity increased proceeding towards the orifice 102. After passing through the orifice 102 the mixture expands at high velocity into the discharge section. The primary and secondary flow passages all open in a radial end wall 104.

The secondary passages 98 are formed to direct the secondary fuel-air mixture flows generally helically into the discharge section 86 where the secondary flows impinge on the primary flow and impart steering forces which create the swirling mixture flows. Preferably the secondary passages are formed by straight cylindrical drilled holes whose centerlines are each skewed with respect to the axis 80 and, in the preferred embodiment, diverge proceeding toward the discharge section 86. The secondary passages each open into the channel 100 about mid-way along its extent to take advantage of the increased velocity pressure and ram effect of the mixture moving through the channel 100. This configuration optimizes the flow rates of the mixture in the secondary passages so that the steering effect of the secondary flows on the primary flow is maximized. In the illustrated and preferred burner constructions the secondary passages are skewed at angles of about 15 degrees with respect to the axis 80 (indicated by the angle A of FIG. 3).

The secondary passages diverge to direct the secondary mixture flows against the discharge section wall upstream from the discharge opening 88 (preferably about half way along the length of the discharge section) in a common plane indicated by the reference character C (FIG. 3). The secondary flows impinge on the primary flow both before and after impinging on the discharge section wall so that the interaction of the secondary flows on the primary flow is maximized. The secondary passages preferably diverge at 15 degree angles from the axis 80 (indicated by the angle B of FIG. 3).

The preferred burner configuration utilizes a primary flow area (at the orifice 102) of as much as 0.40 square inches (a 0.712 inch diameter throat) with eight secondary passages disposed about the primary passage each having a flow area of about 0.008 square inches (0.10 inch diameter drill holes). It has been found that these area relationships between the primary and secondary passages, along with the burner section configurations referred to previously, and the secondary passage angularities relative to the axis 80 contribute importantly to inducing a substantial and effective swirling motion of the mixture in the burner discharge section 86.

The swirling motion imparted to the mixture within the discharge section assures that the mixture and flame issuing from the burner abruptly outwardly from the burner tip to the tube wall regardless of whether a high or low fire condition exists. When the flow of mixture is reduced to "low fire" from "high fire" the flaring flow configuration is maintained essentially unchanged so that the flame base tends to remain within or close to the burner discharge section and does not rise from the burner in such a way as to cause an explosive back flash.

Moreover the centrifugal force exerted by the swirling flow configuration forces the relatively heavy unburned components of the mixture toward contact with the tube wall. The mixture thus tends to be burned in the immediate vicinity of the tube wall with the result that the heat transfer to the tube wall is maximized. This improves the efficiency of the furnace.

The increase in furnace efficiency has been observed by comparing the furnace atmosphere temperature recovery times of two furnaces, identical in all respects except that one furnace was equiped with burners constructed according to the invention having skewed, divergent secondary passages and the other furnace was equipped with conventional burners of the same capacity. Both furnaces were set to operate in the same set point ranges, had identical loads charged in them and the $CO_2$ content of exhaust from each was identical to assure identical combustion efficiencies. The time required for the furnace equipped with the conventional burners to heat up through a predetermined atmosphere temperature range was seven percent longer than that required for the furnace equipped with the new burners. Since the rates of fuel consumption of the furnaces were the same the furnace equipped with the new burners consumed significantly less fuel while responding faster than the conventional furnace.

Further testing conducted on individual heating assemblies has also indicated superior performance of the new burners. Adjacent heating assemblies in a heat treating furnace were equipped, respectively, with a new burner and a prior art burner of the type referred to in the introductory portion of this specification. Each heating tube was equipped with thermocouples at the locations indicated by the capital letters A and B in FIG. 6. The burners were fed from a common manifold and were of the same size or capacity. The furnace was operated with a 1500 pound load at a furnace atmosphere temperature of 1850° F.

The heating tubes each contained a conventional "Flame Buster" which is a ceramic member defining a series of vanes which tend to spiral the burner flame when the flame impinges on the Flame Buster. The Flame Busters are suspended within the heating tubes and are supported by the exhaust end of each associated tube.

The locations indicated by the letter A were all on the centerline of the heating tube, except for the location A' at the top which, in order to avoid interference with the Flame Buster, was located about one forth of the way across the tube. The thermocouple locations indicated by the letter B were each about one sixteenth inch from the tube wall. The Flame Buster vanes are located between one and three feet from the exhaust end of the heating tube and no thermocouples were placed at the tube centerline in this region because of the mixing effect of the vanes and the difficulties involved in mounting the thermocouples. The Flame Busters have an exterior clearance of about one half inch with the heating tube wall which enabled easy placement of thermocouples at the B locations. The table of data of FIG. 7 shows temperature readings taken at the A and B locations of the heating assemblies under high and low fire conditions, together with the temperature differences at corresponding locations of the tubes.

The data of FIG. 7 clearly show that the new burner is effective to maintain higher heating tube wall temperatures and lower temperatures at the center of the heating tube substantially throughout the extent of the heating tube and under both high fire and low fire conditions.

The marked temperature differentials between the corresponding B locations adjacent the Flame Busters is believed to be attributable to the new burners swirling the mixture about the Flame Buster so that the flame is not broken up along the tube wall.

The preferred burner 74 is constructed from first and second members which are configured to simplify machining on the burner as well as to enable salvaging of portions of the burner after partial consumption during usage. As is best illustrated by FIG. 5, the inlet and throat sections 82, 84, including the primary and secondary passages, are all formed in one burner member while the second burner member is a simple straight cylindrical tube which defines the discharge section when assembled to the first burner member.

The first burner member is preferably formed by turning bar stock of a material, such as 302,304 or 310 stainless steel, which is relatively corrosion resistant and has relatively good machining characteristics. The interior of the first member is machined to form the inlet and throat sections as noted above, the end wall 104 and a nipple-like structure 110 surrounding the throat section. The nipple 110 defines a cylindrical outer surface 112 disposed about the throat 102 which terminates in a radial shoulder 114. After the turning operations, the first member is placed in a suitable fixture and the secondary passages are drilled from the end wall 104.

It should be noted that the accessibility of the end face 104 for drilling the secondary passages enables the secondary passages to diverge along skew lines relative to the axis 80 while opening into the converging channel 100. This secondary passage orientation could not be formed in prior art burners.

The second burner member is preferrably turned from bar stock of a "high temperature" material such as INCOLOY 800 (an alloy containing about 35 percent nickel, 25 percent chromium and 40 percent iron) which may not be easily machinable. The open ended straight cylindrical structure of the second burner member is such that after turning, its inner surface is readily accessible to a grinding tool so that a relatively smooth accurately dimensioned discharge section wall can be assured. In the preferred construction the inner surface smoothness of this burner member is around 60 microinches, rms.

The inner diameter of the second member can be accurately dimensioned and is preferably about 0.005 inches less than the diameter of the surface 112 extending around the nipple 110. As shown by FIG. 3 the first and second members are assembled with the nipple 110 projecting into the second member so that the second member abuts the shoulder 114.

The burner members are detachably connected by a "shrink fit" connection. To accomplish this the temperature of the second burner member is elevated substantially above that of the first member so that, due to thermal expansion, the inner diameter of the second member exceeds the nipple structure diameter. The burner members are fitted together held in place while being allowed to reach an equilibrium temperature. The peripheral surface of the nipple structure and second burner member are resiliently engaged and frictionally grip each other whenever they are at a common temperature. The gripping action produces friction forces which are so great that it is virtually impossible to separate the burner members without destroying one or the other of them.

Eventually the second burner member will be consumed as a result of use. When replacement of the burner becomes desirable or necessary the burner members can be separated to enable reuse of the first burner member with a replacement second member. To accomplish this the burner may be inserted partially in an induction heating coil with the second burner member disposed within the coil so that it is rapidly and locally heated relative to the first burner member. When the temperature differential between the burner members is sufficiently great the members can be pulled apart without damaging them. Reuse of the first burner members represents a substantial savings because the first burner member, due to the relatively extensive machining required to make it, is by far the most costly part of the burner to fabricate and is not normally materially corroded or consumed even after long periods of normal usage. Since the second burner member construction requires a relatively few machining operations to produce, the replacement part cost is minimized even though the second burner member is constructed from material which is difficult to machine.

While a single embodiment of the invention has been illustrated and described in considerable detail the invention is not to be considered limited to the precise construction shown. Various adaptations, modifications and uses of the invention may become apparent to those skilled in the art to which the invention relates and the invention is to cover all such adaptations modifications and uses which come within the scope or spirit of the appended claims.

What is claimed is:

1. A burner for maintaining combustion of a gaseous fuel-air mixture in a heat transmitting tube, said burner comprising a burner body defining:

(a) a throat section providing a primary mixture flow passage;

(b) a mixture discharge section defining a discharge opening, said discharge section defined by a surrounding body wall configured to direct said mixture into said heat transmitting tube via said discharge opening along and about a line defining a central axis of said body wall, said discharge section and discharge opening having flow areas which are larger than the flow area of said throat section; and, (c) a plurality of secondary mixture flow passages bypassing at least part of said throat section and opening into said discharge section, said secondary mixture flow passages directing secondary mixture flows into said discharge section in directions diverging obliquely from said axis in the direction of flow and which define relatively small skew angles with respect to said axis, said secondary mixture flows impinging on said body wall and on said primary mixture flow in said discharge section to impart vorticular motion to the mixture issuing from said discharge opening.

2. The burner claimed in claim 1 wherein said body wall defines a straight substantially cylindrical discharge section.

3. The burner claimed in claim 1 further including a converging flow channel leading into said throat section and a radial wall extending about the downstream end of the throat section and to the discharge section wall, said secondary passages opening in said converging channel and in said radial wall.

4. The burner claimed in claim 3 wherein said secondary passages are defined by straight cylindrical drilled holes.

5. The burner claimed in claim 1 wherein said primary and secondary passages are formed in and extend through a first burner member, said discharge section formed in part by an open ended tubular second burner member having an internal cross sectional shape which is substantially the same as the cross sectional shape of said first burner member, said first burner member disposed in and tightly gripped by said second member.

6. The burner claimed in claim 5 wherein said second member is heat shrunk onto said first burner member.

7. The burner claimed in claim 5 wherein said second member is formed from a high temperature highly corrosion resistant metal.

8. The burner claimed in claim 7 wherein said first burner member is formed from a metal which is relatively easier to machine than said second member.

9. A heating assembly for a furnace comprising:

(a) a burner tube from which heat is transferred for heating the furnace; and (b) a burner disposed within the burner tube for directing a gaseous fuel and air mixture along and about a line disposed in the direction of extent of the burner tube to maintain a flame within the burner tube;

(c) said burner comprising: a tubular body connectable to a source of fuel and air mixture; and defining:

(i) a primary mixture flow passage defined at least in part by a flow restricting throat section;

(ii) a discharge section downstream from said throat section, said discharge section having a larger flow area than said throat section, extending around and along said line and terminating in a discharge opening;

(iii) a plurality of secondary mixture flow passages spaced radially from said line for bypassing secondary flows of mixture around said primary passage and discharging said secondary flows at relatively high velocities into said discharge section, said secondary flow passages oriented for directing the secondary mixture flows into said discharge section along secondary flow paths which are skewed at relatively small skew angles with respect to said line, said secondary mixture flows interacting with the primary mixture flow in said discharge section to impart a helical swirling motion to the mixture issuing from said discharge opening.

10. The assembly claimed in claim 9 wherein said secondary flow passages are constructed to direct the secondary flow against the discharge section wall downstream from said flow restricting throat section to maximize the interaction between the primary and secondary flows.

11. The assembly claimed in claim 9 wherein said tubular body is formed by a first body member in which said primary and secondary passages are formed and a second open ended tubular body member defining said discharge section.

12. The assembly claimed in claim 11 wherein one of said members defines a surface extending about and resiliently gripping a conforming surface of the other member.

13. The assembly claimed in claim 11 wherein said first and second body members are attached by a heat shrink connection.

14. The assembly claimed in claim 9 wherein said secondary flow passages direct the secondary flows in divergent directions into said discharge section, said secondary flows impinging on the discharge section wall.

15. The assembly claimed in claim 9 further including a converging channel section opening into said throat section said secondary flow passages opening into said converging channel section and extending therefrom to said discharge section.

16. A high temperature burner connectable to a source of fluent fuel and air mixture comprising:

(a) a first tubular body member communicating with the source and defining a reduced flow throat section forming a primary mixture flow passage opening through a first body member wall at its downstream end, and a plurality of secondary mixture passages opening in said wall radially outwardly from said primary flow passage opening, said throat section formed about a central axis extending in the direction of flow and said secondary flow passages disposed about said axis, said secondary passages diverging obliquely from said axis in the direction of flow and extending at relatively small skew angles with respect to said axis; and, (b) a second tubular burner body member projecting beyond said first body member wall to define a discharge section into which the mixture is directed by said flow passages, and a discharge opening;

(c) said first and second members heat shrunk together and maintained assembled by resiliently engaged conforming surfaces on the respective members which are spaced outwardly from said first body member wall, said members remaining assembled together so long as said members remain at similar temperatures.

17. The burner claimed in claim 16 wherein said second burner member is defined at least in part by a straight cylindrical tube of high temperature corrosion resistant metal, a portion of the inner wall of said member disposed about a cylindrical outer surface of said first burner member, the diametrical extent of said inner wall portion being less than the diametrical extent of said cylindrical outer surface when said members are disassembled and at a common temperature.

18. The burner claimed in claim 16 wherein said second burner member is formed from a corrosion resistant high temperature metal alloy.

19. The burner claimed in claim 16 wherein said discharge section is formed by a cylindrical inner face of said second burner member and said secondary passages are formed to direct secondary flows to impinge on said inner face at locations spaced downstream from said first burner member wall and said primary flow passage.

20. The burner claimed in claim 16 wherein said throat section is defined by a convergent passage portion and a generally cylindrical portion opening in said first body member wall, said secondary passages extending from said throat to said wall.

21. The burner claimed in claim 20 wherein the flow area of said primary flow passage is substantially larger than the total flow area of said secondary flow passages.

* * * * *